US005705210A

United States Patent [19]

Sillince et al.

[11] Patent Number: 5,705,210

[45] Date of Patent: Jan. 6, 1998

[54] DEFORMABLE INSERT FOR A BEVERAGE CONTAINER

[75] Inventors: Mark Erich Sillince, Bedfordshire, United Kingdom; Erwin Anton Rosens, Alpen a/d Rijn, Netherlands

[73] Assignees: Whitbread PLC, London, United Kingdom; Heineken Technical Services B.V., Amsterdam, Netherlands

[21] Appl. No.: 676,326

[22] PCT Filed: Jan. 19, 1995

[86] PCT No.: PCT/GB95/00103

§ 371 Date: Jul. 19, 1996

§ 102(e) Date: Jul. 19, 1996

[87] PCT Pub. No.: WO95/19923

PCT Pub. Date: Jul. 27, 1995

[30] Foreign Application Priority Data

| | | | |
|---|---|---|---|
| Jan. 21, 1994 | [GB] | United Kingdom | 9401167 |
| Jan. 21, 1994 | [GB] | United Kingdom | 9401168 |
| Jul. 7, 1994 | [GB] | United Kingdom | 9413741 |
| Aug. 11, 1994 | [GB] | United Kingdom | 9416290 |

[51] Int. Cl.[6] ..... B65B 31/00; B65B 17/00; B65B 25/00

[52] U.S. Cl. ..... 426/112; 426/115; 426/118; 426/124; 426/131; 53/420; 53/432; 220/521; 220/906

[58] Field of Search ..... 426/106, 112, 426/115, 118, 124, 131, 397, 394, 398, 474, 477; 53/420, 432, 433, 471, 474; 220/906, 501, 521

[56] References Cited

U.S. PATENT DOCUMENTS

| | | | |
|---|---|---|---|
| D. 367,008 | 2/1996 | Sillince et al. | D9/456 |
| D. 374,176 | 10/1996 | Sillince et al. | D9/337 |
| 4,524,805 | 6/1985 | Hoffman | 137/846 |
| 4,627,986 | 12/1986 | Bardsley et al. | 426/112 |
| 5,334,400 | 8/1994 | Purdham | 426/112 |
| 5,584,165 | 12/1996 | Wright | 53/432 |

FOREIGN PATENT DOCUMENTS

| | | |
|---|---|---|
| 1066508 | 4/1967 | United Kingdom . |
| 1331425 | 9/1973 | United Kingdom . |

*Primary Examiner*—Carolyn Paden
*Assistant Examiner*—Curtis E. Sherrer
*Attorney, Agent, or Firm*—Sughrue, Mion, Zinn, Macpeak & Seas, PLLC

[57] ABSTRACT

An insert (20) for use in a container (40) such as a bottle. The insert (20) has a deformable portion, so that in its non-deformed state it is too large to pass through an opening of the container (40) such as the neck of a bottle, yet in its deformed state, the insert (20) may pass through the opening of the container (40). This prevents the insert from being accidentally dentally dispensed with the contents of the container (40).

18 Claims, 3 Drawing Sheets

DEFORMABLE INSERT FOR A BEVERAGE CONTAINER

BACKGROUND OF THE INVENTION

This invention relates to a container including an insert, and in particular to a container such as a bottle, in which the container is filled through its dispensing aperture.

Recently, a number of systems have been proposed for carbonated beverage containers which allow the carbonated beverage to be dispensed so that it has an appearance similar to that of a beverage dispensed from draught. In many of these systems, the container includes a primary chamber for the carbonated beverage, and a secondary chamber which contains fluid under pressure. The inside of the secondary chamber is arranged to communicate with the primary chamber upon opening of the container. This causes the fluid under pressure in the secondary chamber to be jetted into the carbonated beverage causing shear. This encourages the liberation of small bubbles from the beverage which gradually separate out to form a close-knit creamy head. In many of the proposed systems, and especially in those which have been commercialized, the secondary chamber is a separate hollow insert.

Another use for a separate insert is to contain components which are mixed with the main content of the container after filling and sealing of the container.

PRIOR ART

In many of the proposed and commercialized systems in which a container includes a separate insert, the container is a can. In forming and filling a can, the bottom and sides of the can are first formed leaving the entire top of the can open. This provides a large filling aperture through which the insert is introduced into the can. The can is filled subsequently, for example with a beverage, and the top is sealed onto the can. On opening the can, a ring pull or other quick release tab is provided which opens an aperture through which the contents are dispensed. This aperture is much smaller than the filling aperture. Such a system is disclosed in our earlier application WO-A-91/07326.

Containers such as bottles are moulded with a small aperture at the top of the neck through which the container is filled. The aperture is then sealed, for example with a crown cork or screw cap. On opening the container, the entire aperture sealed by the crown cork or screw cap is opened, and therefore the filling and dispensing apertures are the same size.

SUMMARY OF THE INVENTION

According to the present invention, a container includes an aperture and an insert, the insert having a deformable portion, so that in its non-deformed state the insert is too large to pass through an opening of the container, yet in its deformed state, the insert may pass through the opening of the container.

An insert of this type can easily be inserted into a container, but cannot be removed from the container without breaking the container. Therefore, the insert remains in the container as the contents of the container are dispensed, and so the insert cannot accidentally be consumed.

The insert is particularly useful where the container is a bottle, in which the same opening is used for filling as dispensing.

It is preferred that the deformable portion of the insert is a protrusion formed integrally with the remainder of the insert. In this case, it is preferred that the insert is formed from a resilient material, thin enough for it to be deformed around the protrusion. It is particularly preferred that the insert is moulded from a synthetic resin material. This allows for easy manufacture of the insert.

The insert may be formed in two parts which are arranged to be sealingly secured together, for example by snap-fitting or welding.

The insert is preferably arranged to float on the surface of a beverage contained in the container. The insert may have a generally cylindrical shape, and in this case the insert is preferably arranged to float with its longitudinal axis generally parallel to the surface of the beverage. This allows for a large internal volume of the insert, but with a low height when floating on the beverage. Therefore, only a small headspace is required above the beverage in the container.

The insert is advantageously a hollow insert which contains a fluid under pressure, and which further includes a means responsive to the opening of a container in which the insert is provided to allow communication between the inside of the insert and the inside of the container via a restricted orifice. In this way, where the container contains a carbonated beverage, the fluid under pressure in the hollow insert jets into the carbonated beverage in the container on opening the container causing shear in the beverage and therefore encouraging the liberation of small bubbles from the beverage which gradually separate out to form a close-knit creamy head.

Where the insert floats, orientation means are preferably included which orientate the insert so that the restricted orifice is submerged in the beverage. In this case, the orientation means may advantageously be arranged symmetrically relative to a vertical plane containing the restricted orifice. It is particularly preferred in this case that the insert is symmetrical about two mutually perpendicular vertical planes both containing the restricted orifice. This ensures that fluid jetted from the insert will be jetted into the beverage in the container.

Where the insert contains a fluid under pressure, the insert may include a closure for preventing release of the pressurised fluid from the insert, the closure being arranged to be permanently and irreversibly opened on being subjected to a temperature above a pre-determined threshold, or on being subjected to a pressure difference in which the pressure in the container exceeds that within the insert.

Alternatively, the insert may include two opening means, one arranged to allow gas to enter the insert from a headspace above the beverage in a container, and the other arranged to allow gas to jet into the beverage from the insert upon opening the container. In this case, at least one of the opening means is preferably a one-way valve, for example a duckbill valve.

DETAILED DESCRIPTION OF PREFERRED EMBODIMENTS

Figure 1:
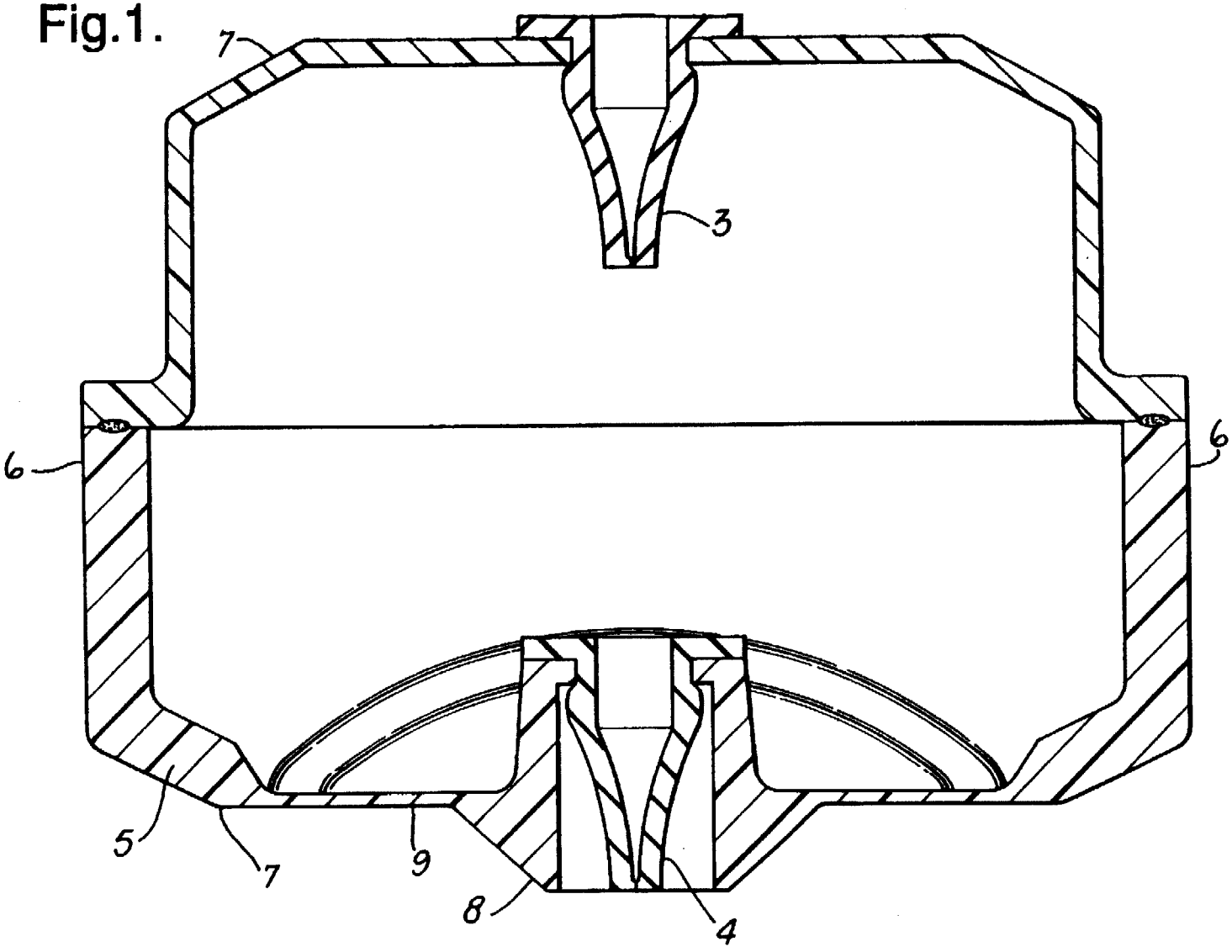
FIG. 1 shows a first example of an insert for use in the present application.

FIG. 1 shows an example of an insert according to the present invention. The insert is generally cylindrical having circular end walls 6 when viewed axially, and a curved side wall 7. Two one-way duckbill valves 3, 4 are mounted on opposite sides of the side wall 7. The insert contains a weighted portion 5, made by forming the lower part of the insert with a thicker portion. This ensures that when the insert is arranged to float on the surface of a beverage in a container, the insert floats in a plane parallel to the longitudinal axis passing through the centre of the end walls 6, with the first duckbill valve 3 above the surface of the beverage, and the second one-way duckbill valve 4 below the surface of the beverage. In use, when the insert is in a container including a carbonated beverage, gas from the headspace above the beverage enters the insert via the first one-way duckbill valve 3, and is subsequently jetted into the beverage via the second one-way duckbill valve 4 upon opening the container.

The insert is formed with a protrusion 8 which surrounds the end of the lips of the second one-way valve 4. This protects the lips of the valve from damage, especially when the insert is forced through the neck of a bottle.

Around the second valve 4, the side wall 7 of the insert contains a portion 9 made from thinner plastics. This allows the protrusion 8 surrounding the valve 4, together with the valve 4, to be depressed towards the central longitudinal axis of the insert. In this way, the insert can be made smaller than the neck of the bottle, allowing the insert to be inserted into the bottle. When the insert is in a bottle, it will return to its normal state with the valve 4 and protrusion 8 protruding beyond the wall 7 of the insert. The insert will then be larger than the neck of the bottle, and so it cannot be removed without breaking the bottle.

Figure 2:
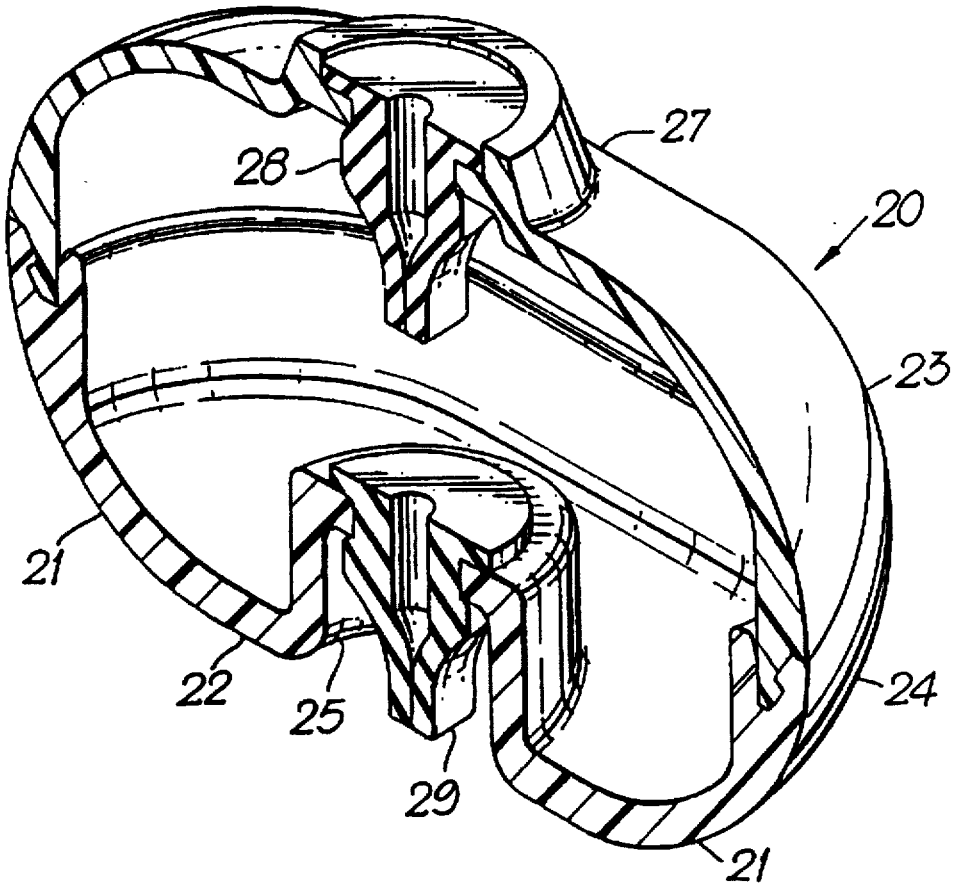
FIG. 2 shows a second example of an insert for use in the present application.
Figure 3:
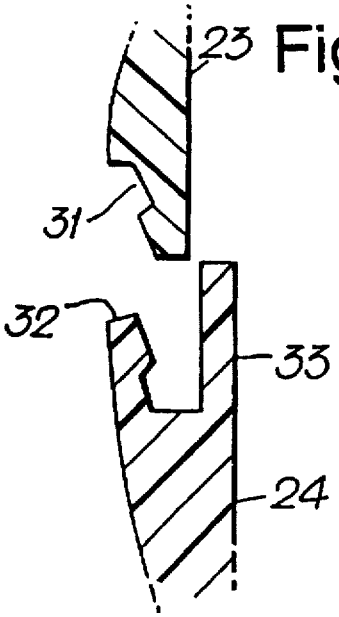
FIG. 3 shows a locking means for locking the two parts of the insert shown in FIG. 2; and, FIG. 4 shows a bottle including an insert according to the present invention.

FIG. 2 shows an alternative configuration of an insert 20. The insert 20 is generally cylindrical, having substantially hemispherical ends 21 connected by a substantially tubular body portion 27. The insert 20 is formed in two halves, a lower part 24, and an upper part 23. As shown in FIG. 3, these two parts may be snap-fitted together. The upper part 23 of the insert 20 may include a circumferential groove 31 around its side wall. The lower part 24 includes a first up-standing rib 32 which is shaped to interlock with the groove 31. A second upstanding rib 33 extends from the lower part 24, and contacts the inner face of the side wall of the upper part 23 opposite the circumferential groove 31. When the upper and lower parts 23, 24 of the insert 20 are snap fitted together, the opposed ribs 32, 33 sandwich the side wall of the upper part 23, thereby retaining the two parts 23, 24. When a pressure difference exists between the inside and outside of the insert 20, the ribs 32, 33 prevent radial movement of the side walls of the upper part 23, and thereby prevent the upper and lower parts 23, 24 from disengaging when the insert is subjected to a large pressure difference between its inside and outside.

In this example, the insert 20 includes two one-way valves 28, 29, valve 28 allowing gas from the headspace to pass into and pressurise the insert 20, the valve 29 allowing gas to be jetted from the insert 20 into carbonated beverage on which the insert floats. The second one-way valve 29 is mounted in an up-standing portion 25 of the lower part 24 of the insert 20. In this way, the lips of the valve 29 are surrounded by the insert 20, and therefore when the insert is pushed through the neck of a bottle, the lips of the valve 29 are protected. The first one-way valve 28 is mounted in an up-standing projection 27. Due to the resilience of the material from which the insert 20 is made, the protrusion 27 may be deformed towards the central longitudinal axis of the insert 20, thereby allowing the insert 20 to pass through the neck of a bottle. As with the first example, when the insert 20 has been inserted into a bottle, it returns to its normal state in which the insert is too large to pass through the neck of the bottle, and therefore cannot be dispensed without breaking the bottle.

Figure 4:
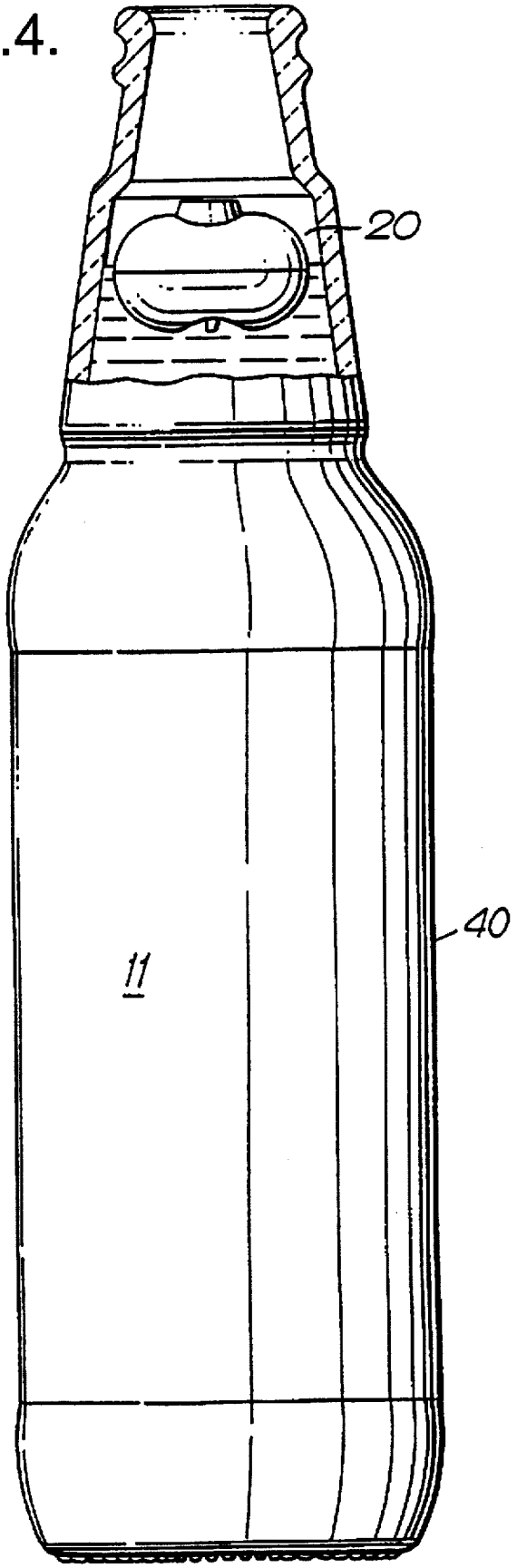

FIG. 4 shows the insert 20 of FIG. 2 included in a bottle 40 with carbonated beverage 11. In this case, the insert floats on the surface of the beverage with the first one-way valve 28 in the headspace and the second one-way valve 29 below the surface of the beverage 11.

The insert may be used for other purposes, for example for containing a component to be added to the contents of the container after filling. Where the insert is included in a container for a carbonated beverage to produce a draught like appearance in the beverage when dispensed, other arrangements may be provided for introducing pressurised fluid into the insert, for example by pre-charging before the insert is introduced into the container, and by which the inside of the insert is arranged to communicate with the beverage upon opening the container. This may include a closure which is arranged to be permanently opened by a high temperature or pressure, for example a temperature or pressure obtained during pasteurisation.

We claim:

1. A container (40) including an aperture and an insert (20), the insert (20) having a deformable portion (8, 9, 27), so that in its non-deformed state the insert (20) is too large to pass through the aperture of the container (40), yet in its deformed state, the insert (20) may pass through the aperture of the container (40), in which the insert (20) is arranged to float on the surface of a beverage contained in the container (40), and in which the insert (20) contains a fluid under pressure, and further includes a means responsive to the opening of the container to allow communication between the inside of the insert and the inside of the container via a restricted orifice.

2. A container (40) according to claim 1, in which the deformable portion (8, 9, 27) of the insert (20) comprises a protrusion (8, 27) formed integrally with the remainder of the insert (20).

3. A container (40) according to claim 1 in which the insert (20) is formed from a resilient material, thin enough for it to be deformed.

4. A container (40) according to claim 1, in which the insert (20) is molded from a synthetic resin material.

5. A container (40) according to claim 1, in which the insert (20) is arranged to be sealingly secured together.

6. A container according to claim 5, wherein the insert is arranged to be snap-fitted together.

7. A container according to claim 5, wherein the insert is arranged to be welded together.

8. A container (40) according to claim 1, in which the insert (20) has a generally cylindrical shape, and is arranged to float with its longitudinal axis generally parallel to the surface of the beverage.

9. A container (40) according to claim 8, in which the insert (20) further includes orientation means which orient the insert so that the restricted orifice is submerged in the beverage.

10. A container (40) according to claim 9, in which the insert (20) includes a closure for preventing release of the pressurised fluid from the insert, the closure being arranged to be permanently and irreversibly opened on being subjected to a temperature above a predetermined threshold, or on being subjected to a pressure difference in which the pressure in the container exceeds that within the insert.

11. A container (40) according to claim 1, in which the insert (20) includes a closure for preventing release of the pressurised fluid from the insert, the closure being arranged to be permanently and irreversibly opened on being subjected to a temperature above a pre-determined threshold, or on being subjected to a pressure difference in which the pressure in the container exceeds that within the insert.

12. A container (40) according to claim 1, in which the insert (20) further includes orientation means which orient the insert so that the restricted orifice is submerged in the beverage.

13. A container (40) according to claim 12, in which the orientation means of the insert (20) are arranged symmetrically relative to at least one vertical plane containing the restricted orifice.

14. A container (40) according to claim 13, in which the insert (20) includes a closure for preventing release of the pressurised fluid from the insert, the closure being arranged to be permanently and irreversibly opened on being subjected to a temperature above a predetermined threshold, or on being subjected to a pressure difference in which the pressure in the container exceeds that within the insert.

15. A container (40) according to claim 13, in which the insert (20) further includes two opening means, one arranged to allow gas to enter the insert from a headspace above the beverage in the container, and the other arranged to allow gas to jet into the beverage from the insert upon opening the container.

16. A container (40) according to claim 12, in which the insert (20) includes a closure for preventing release of the pressurised fluid from the insert, the closure being arranged to be permanently and irreversibly opened on being subjected to a temperature above a predetermined threshold, or on being subjected to a pressure difference in which the pressure in the container exceeds that within the insert.

17. A container (40) according to claim 1, in which the insert (20) further includes orientation means which orient the insert so that the restricted orifice is submerged in the beverage.

18. A container (40) according to claim 17, in which the insert (20) includes a closure for preventing release of the pressurised fluid from the insert, the closure being arranged to be permanently and irreversibly opened on being subjected to a temperature above a predetermined threshold, or on being subjected to a pressure difference in which the pressure in the container exceeds that within the insert.

* * * * *